United States Patent [19]

Silva

[11] 4,012,846

[45] Mar. 22, 1977

[54] APPARATUS FOR CONCENTRATING LIQUID-SOLID MIXTURE

[76] Inventor: Rene N. Silva, 555 Cliff St., Ridgewood, N.J. 07450

[22] Filed: July 28, 1975

[21] Appl. No.: 599,331

[52] U.S. Cl. ..... 34/57 R; 159/4 R; 432/58

[51] Int. Cl.[2] ..... F26B 17/00

[58] Field of Search ..... 34/57 R, 68, 69; 159/4 R, 4 A, 45 R, DIG. 6; 432/58

[56] References Cited

UNITED STATES PATENTS

| | | | |
|---|---|---|---|
| 790,162 | 5/1905 | Trump | 34/57 R |
| 853,260 | 5/1907 | Passburg | 159/7 |
| 2,533,125 | 12/1950 | Levinson et al. | 159/DIG. 6 |
| 3,163,587 | 12/1964 | Champe | 159/45 R |

*Primary Examiner*—John J. Camby
*Attorney, Agent, or Firm*—Brooks Haidt Haffner & Delahunty

[57] ABSTRACT

Apparatus for removing at least a portion of the liquid from a liquid-solid mixture in which the liquid-solid mixture is sprayed into one end of a substantially peripherally continuous, moving wall tube and a heated gas is caused to flow through the tube either in the same direction or the opposite direction as the flow of the liquid-solid mixture spray. The tube is formed by moving belts or is a rotatable hollow cylinder, and deposits on the wall of the tube are scraped from the wall by blades or knives. The tube is surrounded by an enclosing tube, and the separated solids, or liquid-solid mixture of lower liquid content, are received in a hopper or on moving belts below the first-mentioned tube from which such solids, or mixture, are removed. After passing through the first-mentioned tube, the gases are vented to the atmosphere or further processed. The apparatus may also be used to remove products of combustion from the gases.

15 Claims, 9 Drawing Figures

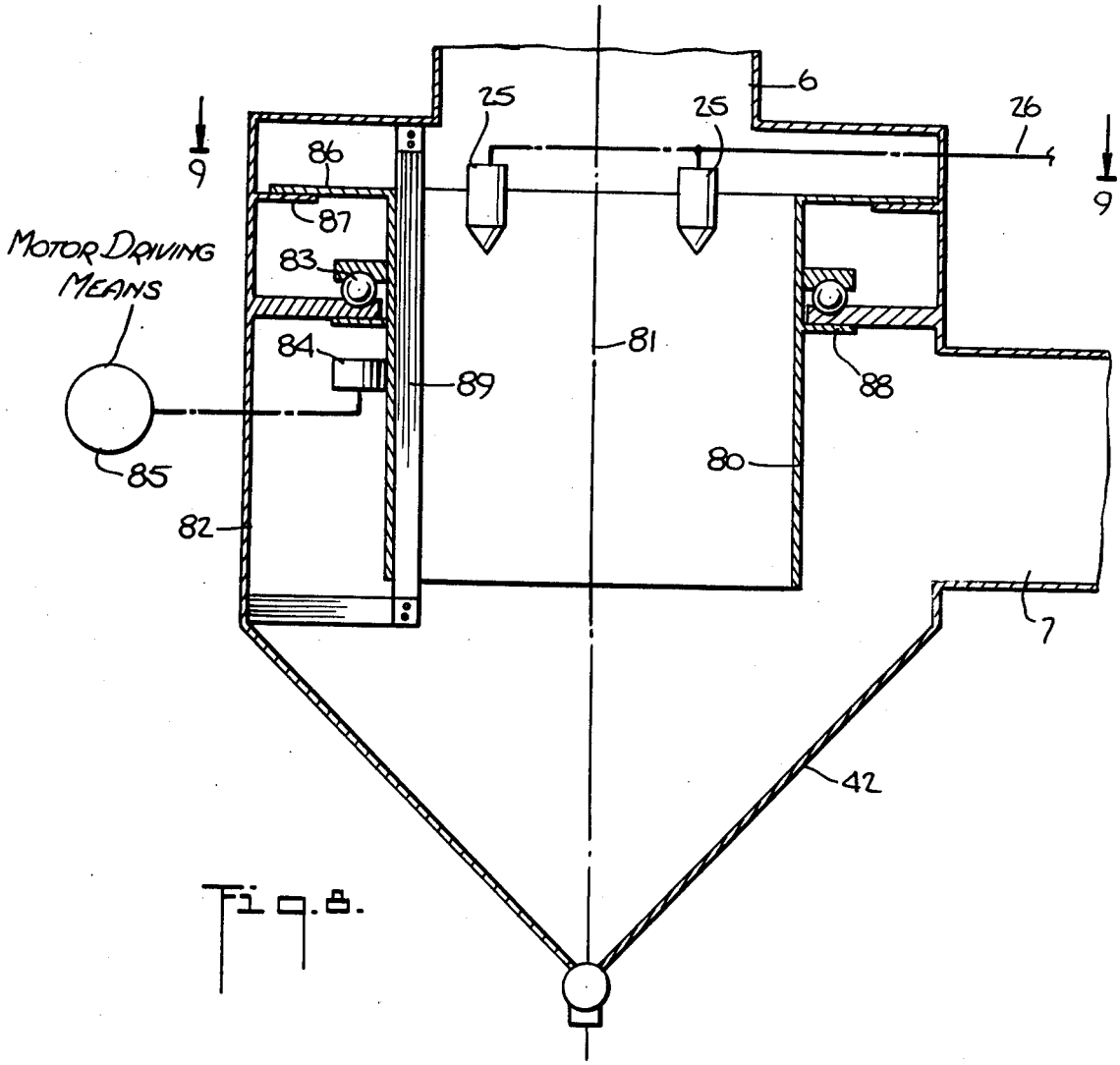
Fig. 8.
Fig. 9.
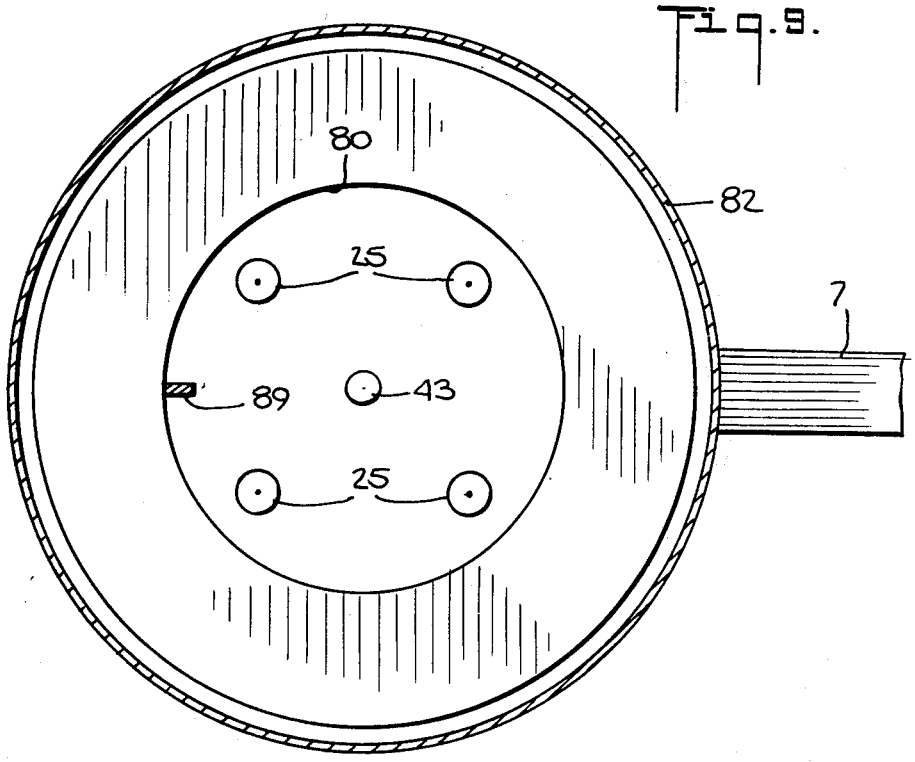

APPARATUS FOR CONCENTRATING LIQUID-SOLID MIXTURE

This invention relates to apparatus for the removal of at least a portion of a liquid from a mixture of such liquid and a solid forming material, the solid forming material being either in suspension or dissolved in such liquid.

Various types of plants, such as electric power plants, chemical plants, etc., produce wastes which must be disposed of and typically, such wastes are in the form of water suspensions or solutions of a solid. The water can, of course, be evaporated to the atmosphere and usually the solids must otherwise be disposed of. In order to keep disposal costs to a minimum, the water content of the waste, which may, for example, be a sludge, should be made as low as possible consistent with the economics of removing the water. Prior art practices for removal of the water usually involve a plurality of treatment stages, such as evaporation, thickening, filtering, etc.

Typical electric power plant wastes are those resulting from the treatment of water, equipment washings, and the treatment of flue gases which contain fly ash and, normally, sulfur dioxide. Part of the treatment often involves the use of a calcium containing compound, such as lime, limestone, etc., which forms, with the sulfur dioxide, calcium sulfate, as well as other chemical products.

Calcium sulfate solutions become saturated at very low concentrations, normally under 0.2% by weight, and when such solutions are subjected to evaporation, calcium sulfate rapidly builds up a coating of scale on the parts of the evaporator which the solutions contact. Thus, the evaporator must either be shut down frequently for the removal of the scale, or the evaporating liquid must flow through the evaporator at a high rate, which means a waste of heat in order to maintain a fairly low concentration of solids in the feed solution to avoid scaling it up.

Similarly, in processing of sugar cane juice, the evaporators for concentrating the juice become rapidly coated with scale requiring relatively frequent shutdown of the evaporators for cleaning purposes. Again, the problem is at least partially due to the use of lime in the pre-treatment of the sugar juice together with the calcium brought in by the sugar juice itself.

One object of the invention is to provide apparatus for the separation of a solid material from a liquid containing such material, in which apparatus said material in solid form is continuously removed so that shutdown, for removal of said material, is not required except possibly infrequently.

Another object of the invention is to provide such apparatus which will, at the same time that it separates such solid material from the liquid, cause removal of combustion products which may be present in heated gases which are used in the separating apparatus and thereby, to remove as solids which may be harmful to the environment, such as sulfur compounds.

A further object of the invention is to provide a single apparatus for performing a plurality of operations in a plant which are normally performed by a plurality of different devices, such as a scrubber, a thickener, a dryer, a precipitator, etc.

In the preferred embodiment of the invention, as applied to an electric power plant, the plant wastes, in the form of a water-solid mixture, are sprayed into one end of a tube having a substantially peripherally continuous wall formed by one or more driven and moving parts, such as a plurality of belts. Heated flue gas from the plant and containing solids to be removed is also supplied to said end of the tube and is removed and vented at the opposite end of the tube. Solid material which adheres to said belts is scraped off by a knife or knives and such material, along with solid particles which fall out of the opposite end of said tube, are removed from below said opposite end of said tube. Preferably, the tube wall is formed by a plurality of adjacent belts carried by vertically spaced rollers, at least one roller for each belt being driven so that the face of each belt facing inwardly of the tube moves in the direction of solids flow. The edges of the belts are arranged in overlapping relation and, preferably, the tube is surrounded by gas at a pressure higher than that of the gas interiorly of the tube.

In an alternative embodiment of the invention, the tube is a hollow cylinder, rotatable around a vertical axis.

Other objects and advantages of the present invention will be apparent from the detailed description of the preferred embodiments, which should be considered in conjunction with the accompanying drawings in which:

FIGS. 2 and 3 are, respectively, a diagrammatic, plan view of the apparatus of the invention with the cover thereof removed on FIG. 2, and a diagrammatic, cross-sectional, side elevation view of the apparatus of the invention taken along the line 3—3 indicated in FIG. 2 with the cover on;

FIG. 9 is a simplified, cross-sectional, plan view of the apparatus of the invention shown in FIG. 8 and is taken along the line 9—9 indicated in FIG. 8.

Figure 1:
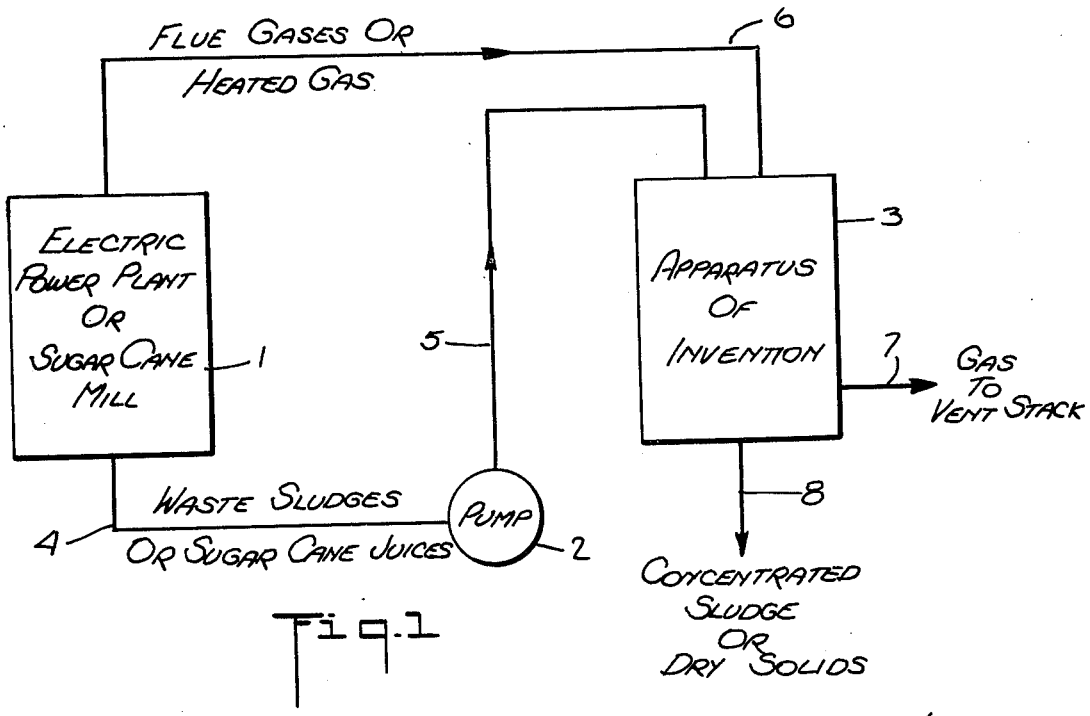
FIG. 1 is a schematic diagram illustrating the use of the apparatus of the invention with an electric power plant or a sugar cane mill.

Although it will be apparent to those skilled in the art that the apparatus of the invention has many different applications, FIG. 1 illustrates the application of the apparatus of the invention in the processing of waste sludges from an electric power plant and the removal of solid or solid forming materials from the flue gases thereof, and the application of the apparatus of the invention to the separation of sugar crystals or the concentration of the sugar cane juice in a sugar cane mill.

Taking first the use of the apparatus of the invention in connection with an electric power plant, it is known in the art that such a plant produces wastes in the form of sludges and emits flue gases which usually include gaseous $SO_2$ and solids, such as fly ash. The sludges may be those produced in the treatment of water for a steam boiler or equipment wash and/or may be the sludges produced in scrubbers used for scrubbing the flue gases. In the scrubbers, lime, powdered limestone or other scrubbing chemicals may be used to remove sulfur dioxide, residual fly ash, etc. The flue gases, which are at a relatively high temperature as compared to ambient temperature, usually comprise several gases, such as air, carbon dioxide, carbon monoxide, sulfur dioxide, etc. The waste sludges are pumped by a pump 2 from the plant 1 to the apparatus of the invention 3 by way of lines 4 and 5, the waste sludges usually containing sufficient water to permit pumping thereof. The heated flue gases are supplied to the apparatus of the invention 3 from the plant 1 by means of a line or duct 6 in any conventional manner. After the flue gases pass through the apparatus 3, they are vented by way of a line or duct 7 to a conventional vent stack (not shown). Solids in dry or substantially dry form, or in the form of a concentrated sludge, are removed from the apparatus 3 at the bottom thereof as indicated by the arrow 8.

When the apparatus of the invention is used in connection with a sugar cane mill, heated air from the plant 1 is supplied to the apparatus 3 by way of the line or duct 6 and sugar cane juice, usually treated with lime for clarification purposes, is supplied to the apparatus 3 by way of the lines 4 and 5. If the apparatus 3 is used merely to concentrate the sugar cane juice, heated air along with moisture is vented to the vent stack by way of the line or duct 7 and concentrated juice is removed from the apparatus 3 at the bottom thereof as indicated by the arrow 8. On the other hand, with the apparatus 3 it is possible to concentrate the sugar cane juice to the extent that crystals of sugar or a mixture of sugar crystals and molasses may be removed from the bottom of the apparatus 3.

Figure 2:
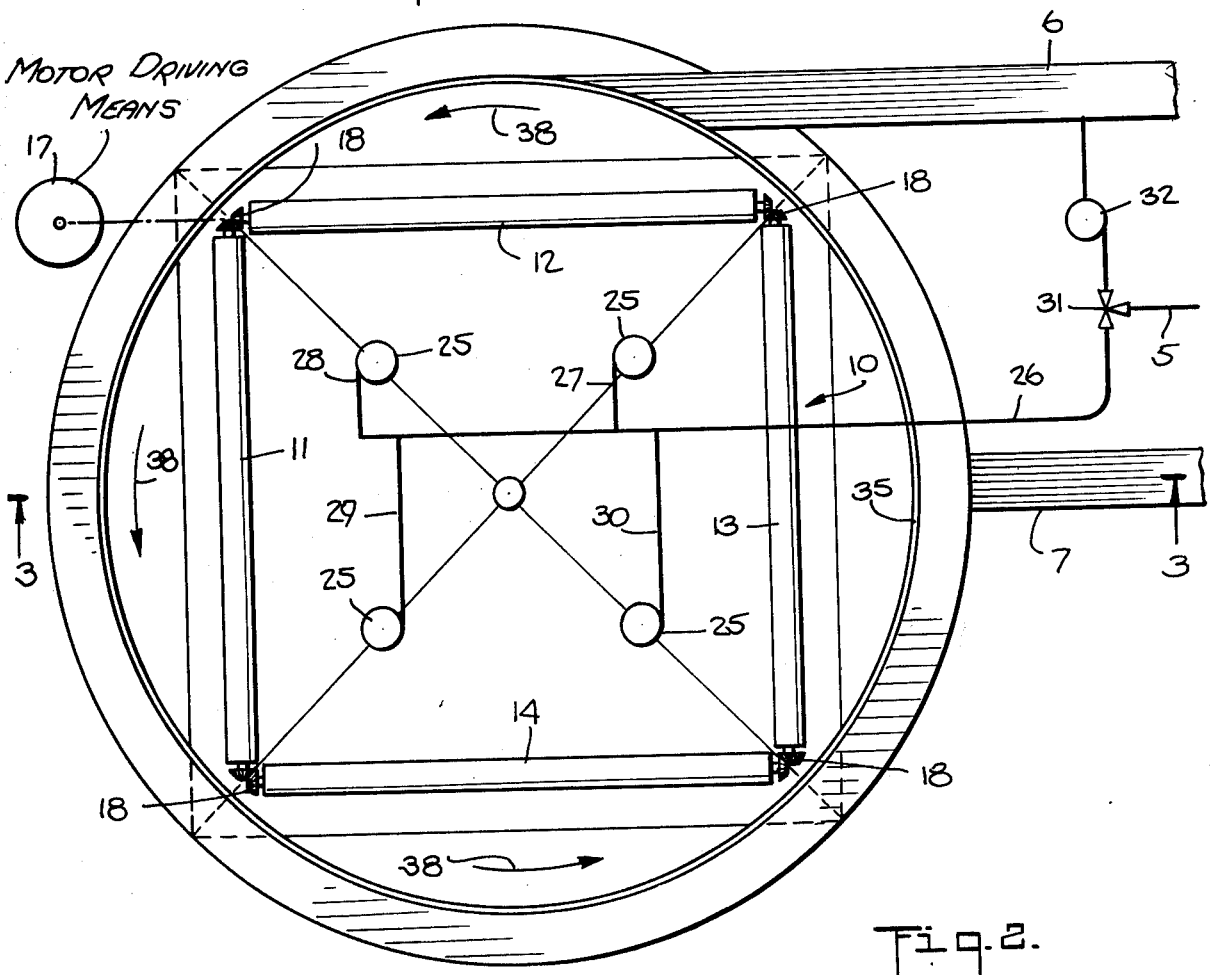

With reference to FIGS. 2 and 3, the preferred embodiment of the apparatus of the invention comprises a tube 10 of rectangular cross-section, the wall of the tube 10 being formed by a plurality of travelling belts 11–14. Although four belts 11–14 have been shown, it will be apparent that the number of belts may be only three or may be greater in number than four.

Each of the belts 11–14 may be formed of any known flexible material which prevents any substantial rate of flow of gases from the interior of the tube 10 through the belts 11–14 to the exterior of the tube 10. They may, for example, be made of relatively hard felt, fine pored fiber glass cloth, etc. However, it is preferred that the belts 11–14 be made of a substantially imperforate material which will prevent the flow of gas from the interior of the tube 10 to the exterior of the tube 10 through the belts 11–14 and which has a smooth surface which reduces adhesion of the solids in the liquid-solid mixture to the surface of the belts 11–14. The belts 11–14 may, for example, be made of fiber glass cloth coated on at least one surface thereof, the surface facing inwardly of the tube 10, with an anti-adhesive plastic, such as polytetrafluorethylene, sold under the trademark TEFLON, or polyvinylidene fluoride, sold under the trademark KYNAR, by Pennwalt Corporation, Philadelphia, Pa. Alternatively, the belts 11–14 may be made of a reinforced rubber of a type having good anti-adhesive properties. The material employed for the belts 11–14 must also be able to withstand the temperatures within the apparatus of the invention and have good tensile strength and wearing properties.

The belts 11–14 are each mounted on vertically spaced rollers which may be supported in any conventional manner, such as by bearings on the wall of the second tube hereinafter described. For example, the belt 11 is mounted on an upper roller 15 and a lower roller 16, the upper roller 15 being driven by a motor driving means 17 through conventional gearing, such as bevel gears 18 which, preferably, are enclosed.

The belt 13 is similarly mounted on an upper roller 19 and a lower roller 20, the upper roller 19 being driven by the motor driving means 17. The belts 12 and 14 are mounted in upper and lower rollers in the same manner as the belts 11 and 13 and the upper rollers thereof are driven by the motor driving means 17 in a conventional manner, such as through the bevel gears 18. When the apparatus of the invention is in operation, the motor driving means 17 causes the surfaces of the belts 11–14 which face toward the interior of the tube 10 to move downwardly as indicated by the arrows 21 shown in FIG. 3. The surface speed of the belts 11–14 may, for example, be about 1 to 20 feet per minute.

Preferably, the lower rollers which support the belts 11–14, such as the rollers 16 and 20, are of relatively small diameter, for example, 6 to 12 inches in diameter, so as to cause flexing of the belts 11–14 as they pass around the rollers thereby aiding in dislodging any solids which may have adhered to the surfaces of the belts 11–14. The upper rollers 15 and 19 may be of a larger diameter for driving purposes. A plurality of blades or knives, such as the blades or knives 22 and 23, corresponding in number to the number of belts 11–14, are positioned adjacent the lower belt supporting rollers and engage the surfaces of the belts 11–14 so as to scrape off the surfaces of such belts any solids which may adhere to such surfaces. Such blades preferably lie in planes substantially tangent to the lower belt supporting rollers, but the planes of such blades may extend at an angle to the belt surfaces, e.g., at an angle up to 90°. The solids which are scraped off the belts 11–14 or which fall off the belts 11–14 due to flexing thereof, fall downwardly into solids receiving means described hereinafter.

A plurality of spray nozzles 25 are mounted adjacent the upper end of the tube 10 and the liquid-solid mixture is supplied under pressure to the nozzles through lines 26–30. The nozzles 25 may be of a known type which atomize or produce very fine drops of spray at the outlets of the nozzles 25. Although a single nozzle 25 may be employed, it is preferred to use a plurality of nozzles 25 to distribute the liquid-solid mixture spray over a wider area and to increase the rate of treatment of the liquid-solid mixture. The nozzles 25 are constructed to direct the spray mainly in the downward direction, and generally parallel to the axis of the tube 10.

The liquid-solid mixture may be supplied directly to the line 26 by the line 5 but, in the preferred embodiment of the invention, heated air or gas from the duct 6 is mixed with the liquid-solid mixture as the latter is supplied to the nozzles 25. Thus, in the preferred embodiment of the invention, the liquid-solid mixture is supplied by the line 5 to a known type of venturi device 31, the outlet of which is connected to the line 26. The venturi device 31 is also connected to a gas compressor 32, the inlet of which is connected to the duct 6 and draws heated air or gas therefrom. The characteristics of the nozzles 25 and the pressure at which the liquid-solid mixture is supplied to the nozzles 25, is determined in a manner well-known to those skilled in the art, and depends primarily upon the type of waste and desired dryness of the solids separated from the liquid-solid mixture.

In the preferred embodiment of the invention, the tube 10 is surrounded by a second tube 35 which is circular in cross-section, but the second tube 35 may have a different cross-section. The tube 35 has a cover 36 at one end and is partially closed at its opposite or lower end by an inwardly extending portion 34. The upper end of the tube 10, as viewed in FIG. 3, is spaced downwardly from the cover 36 so as to permit heated gases from the duct 6 to flow into the tube 10 along the paths indicated by the arrows 37. In order to improve the distribution of the gases, the exterior of the tube 10 is also spaced from the interior of the tube 35 so as to permit heated gases to flow from the duct 6 around the exterior of the tube 10 as indicated by the arrows 38 (FIG. 2). Thus, heated gases supplied by the duct 6 which may, for example, have a velocity of about 100 feet per second, flow into the tube 10 and at the bottom of the tube 10 flow outwardly, as indicated by the arrow 40, to the duct 7, which directs the gases to a vent stack (not shown). Of course, if the gases are useful, they may be directed to other apparatus instead of a vent stack.

The tube 35 is surrounded at its lower portion by a further tube 41 which is in sealed relation at its upper end with respect to the tube 35. The tube 41 forms part of the passageway for the gas which flows out of the tubes 10 and 35 to the duct 7.

A conical hopper 42 extends downwardly from the lower wall 39 of the tube 41 and the upper end of the hopper 42 extends beneath the tube 10 and the belts 11–14 for receiving solids which fall out of the tube 10 and which are scraped off the belts 11–14. The lower end of the hopper 42 is provided with a conventional rotatable valve 43 through which the solids deposited in the hopper 42 may be removed. The valve 43 preferably is of a type which permits removal of the solids while the apparatus of the invention is in operation.

As indicated in FIG. 3, the liquid-solid mixture is sprayed by the nozzles 25 in the form of liquid drops 45 containing the solid either in suspension or in solution. When the liquid-solid mixture issues from the nozzles 25 the drops are comparatively large in size, but as indicated by the dots 46 and 47, the drops decrease in size as they fall downwardly through the tube 10 because of vaporization of the liquid. Depending upon the fineness of the spray emitted by the nozzles 25, the axial length of the tube 10, the rate of flow and temperature of the gas supplied by the duct 6 and the liquid content of the liquid-solid mixture supplied to the nozzles 25, as well as other factors known to those skilled in the art, the solids entering the hopper 42 may be substantially dry or may still be mixed with a substantial amount of the original liquid. However, the ratio of liquid to solid in the hopper 42 will be substantially less than the ratio thereof as supplied to the nozzles 25.

It will be observed that the liquid-solid mixture in spray form is directed generally along the axis of the tube 10; that is, it is not intended that drops of the liquid-solid mixture fall on the belts 11–14. However, it is not possible as a practical matter, or necessary in the apparatus of the invention, to prevent the liquid-solid drops from falling on the belts 11–14. In addition, because of turbulence within the tube 10, some of the liquid-solid drops will strike the belts 11–14. When such drops fall on the belts 11–14, and particularly when the liquid-solid mixture contains calcium sulfate, solids will be deposited on and adhere to the belts as indicated by the layers 48 and 49 on the belts 11 and 13. If such deposited solids are permitted to accumulate on the belts, it would be necessary, in a relatively short period of time, to discontinue the operation of the apparatus of the invention to permit removal of such solids. With the apparatus of the invention, the solids deposited on the belts 11–14 are scraped off by the blades mentioned hereinbefore, e.g., blades 22 and 23, and fall into the hopper 42.

If the gases supplied to the apparatus of the invention by the duct 6 contain solids such as fly ash, at least a portion of such solids will be removed from the gases in the tube 10 by contact with the drops of liquid-solid mixture within the tube 10. In addition, if the gases include sulfur or sulfur compounds, such as sulfur dioxide, and the liquid-solid mixture includes a calcium compound, then some of the sulfur or sulfur compounds will be removed from the gases by contact with the drops of the liquid-solid mixture within the tube 10.

Although it is preferred that the gases from the duct 6 be directed downwardly through the tube 10, it will be apparent that the gases may be supplied to the apparatus of the invention through the duct 7 and withdrawn from the apparatus of the invention through the duct 6. The gases in such case flow upwardly through the tube 10 and in a direction opposite to the direction of flow of the drops of the liquid-solid mixture. With such direction of gas flow, the gas pressure inside the tube 10 usually will be higher than the gas pressure therearound, which may require the use of means at the edges of the belts 11–14 to prevent or reduce the flow of gas outwardly of the tube 10 between the edges of the belts 11–14.

By reason of the construction of the apparatus of the invention described hereinbefore, and the manner in which the gases are supplied to the apparatus by the duct 6 and the flow thereof in the same direction as the flow of the liquid-solid mixture, the pressure of the gas within the tube 10 normally will be slightly less than the pressure of the gas between the tube 35 and the tube 10 so that the belts 11–14 will be urged inwardly toward the axis of the tube 10. Such difference of pressure will aid in maintaining the edges of the belts 11–14 in contact and in confining the liquid-solid spray within the tube 10. In order that the belts 11–14 will maintain relatively flat surfaces when subjected to such difference of pressure, they may be supported by a plurality of bars 50 extending transversely of the belts 11–14.

Normally the operation of the apparatus may be adjusted so that the solids falling into the hopper 42 will not adhere to the walls of the hopper 42 to the extent that an accumulation of solids will interfere with the operation of the apparatus. However, under certain conditions the solids may stick to the walls of the hopper and cause a build-up requiring shut-down of the apparatus for the removal of the solids. In such situations, the hopper 42 may be replaced by the solids receiving apparatus illustrated in FIGS. 4 and 5.

Figure 4:
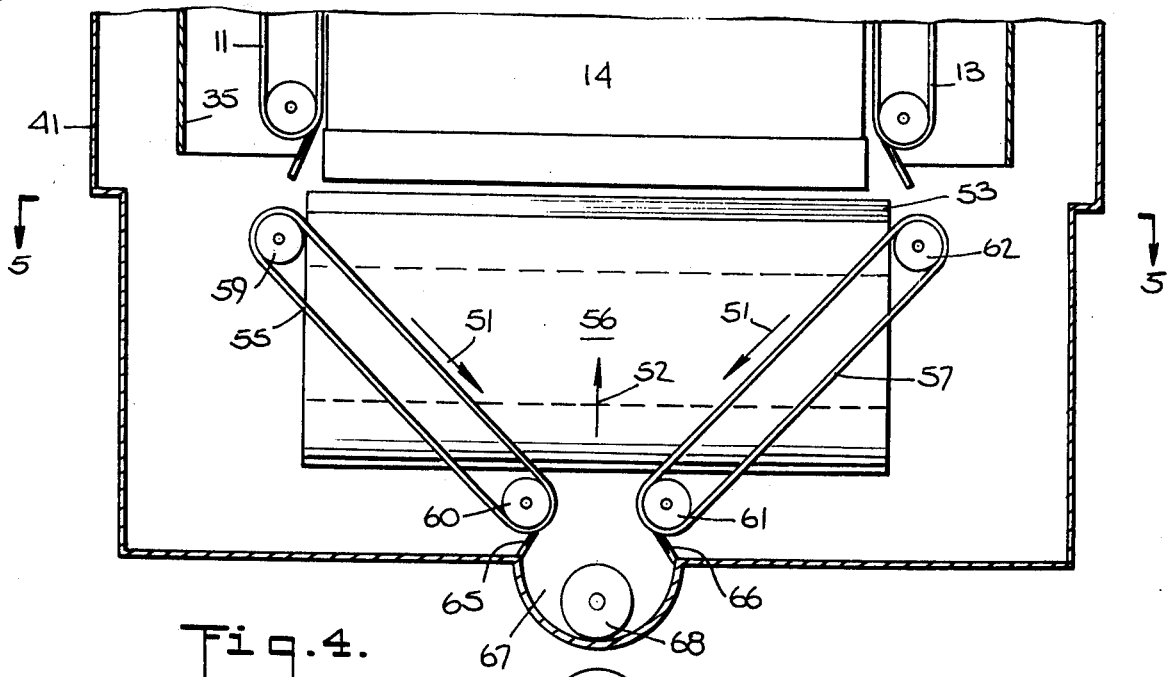
FIG. 4 is a diagrammatic, side elevation view, partly in cross-section, of a modified embodiment of the portion of the apparatus of the invention which receives the solids.
Figure 5:
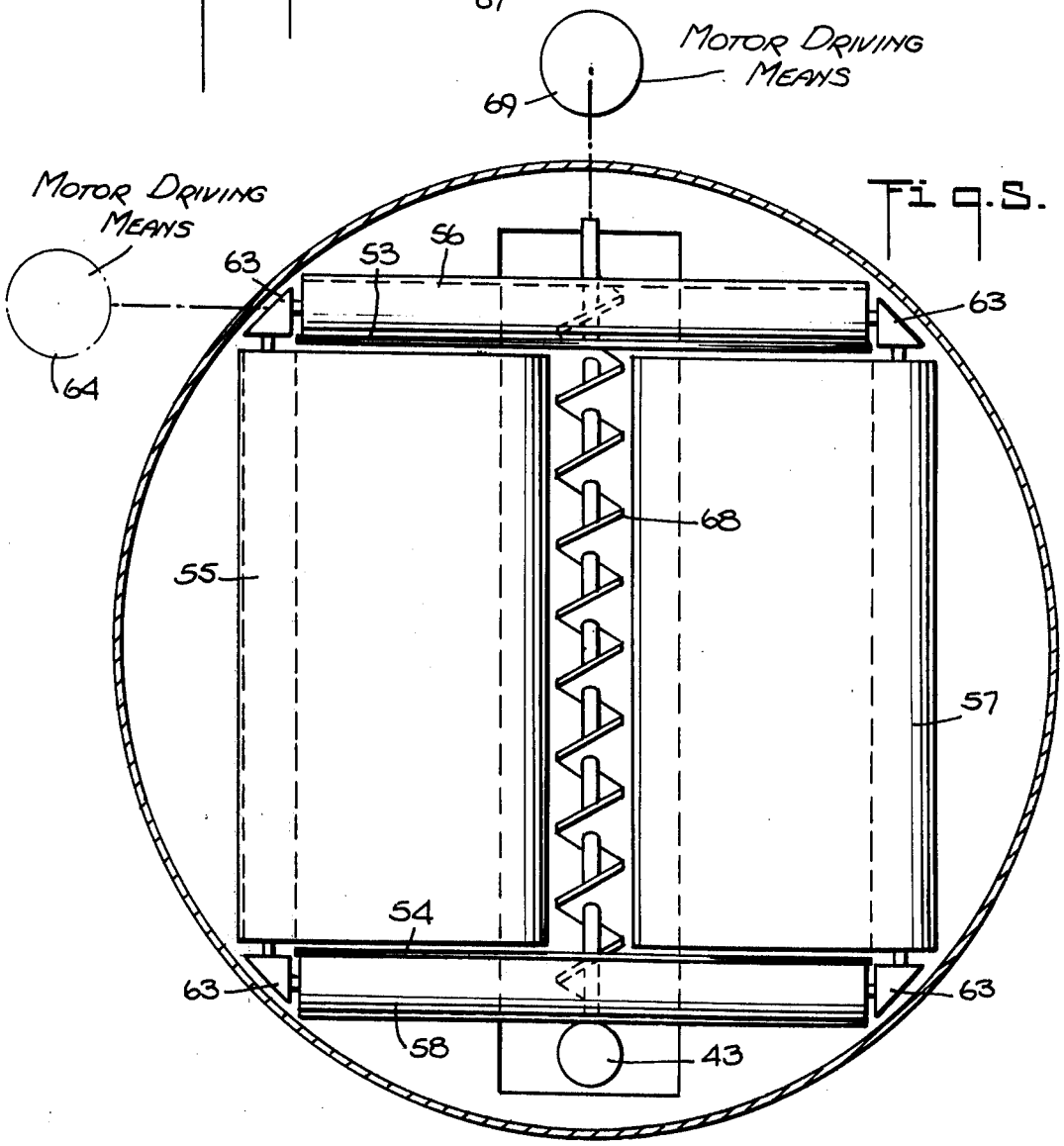
FIG. 5 is a plan view of a portion of the apparatus shown in FIG. 4 and is taken along the line 5—5 indicated in FIG. 4.

The solids receiving apparatus illustrated in FIGS. 4 and 5 comprises a plurality of driven belts 55–58, such belts being mounted and driven in a manner similar to the belts 11–14. Thus, each of the belts 55–58 may be mounted on a pair of rollers, such as the rollers 59–62, the upper rollers of which may be interconnected by suitable gears 63, and driven by driving means 64, so that the upper surfaces of the belts 55 and 57 move downwardly, as indicated by the arrows 51, and the inwardly facing surfaces of the belts 56 and 58 move upwardly, as indicated by the arrow 52. A knife or blade 65 may be mounted to engage the surface of the belt 55 and a knife or blade 66 may be mounted to engage the surface of the belt 57 so as to scrape solids off such belts as they are driven. The solids falling from the belts 55 and 57 will be received in a sump 67 in which there is a screw-type conveyor 68 driven by driving means 69. The conveyor 68 conveys the solids to the valve 43 through which the solids may be removed.

It will be noted that the belts 55 and 57 have their upper surfaces in planes substantially at right angles to each other, whereas the major surfaces of the belts 56 and 58 are substantially vertical. Scraping knives or blades 53 and 54 may be employed to engage the belts 56 and 58 and to scrape off solids adhering to the surfaces of the belts 56 and 58.

Figure 6:
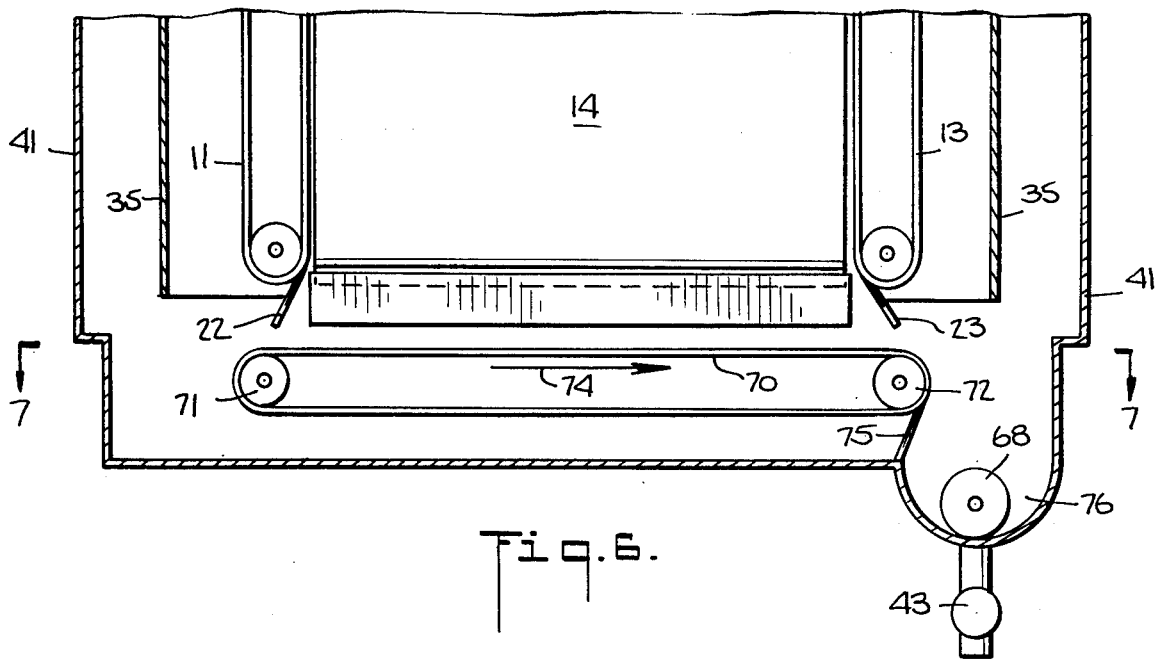
FIG. 6 is a diagrammatic, side elevation view, partly in cross-section, of a modified form of the portion of the apparatus of the invention which receives and removes the solids.
Figure 7:
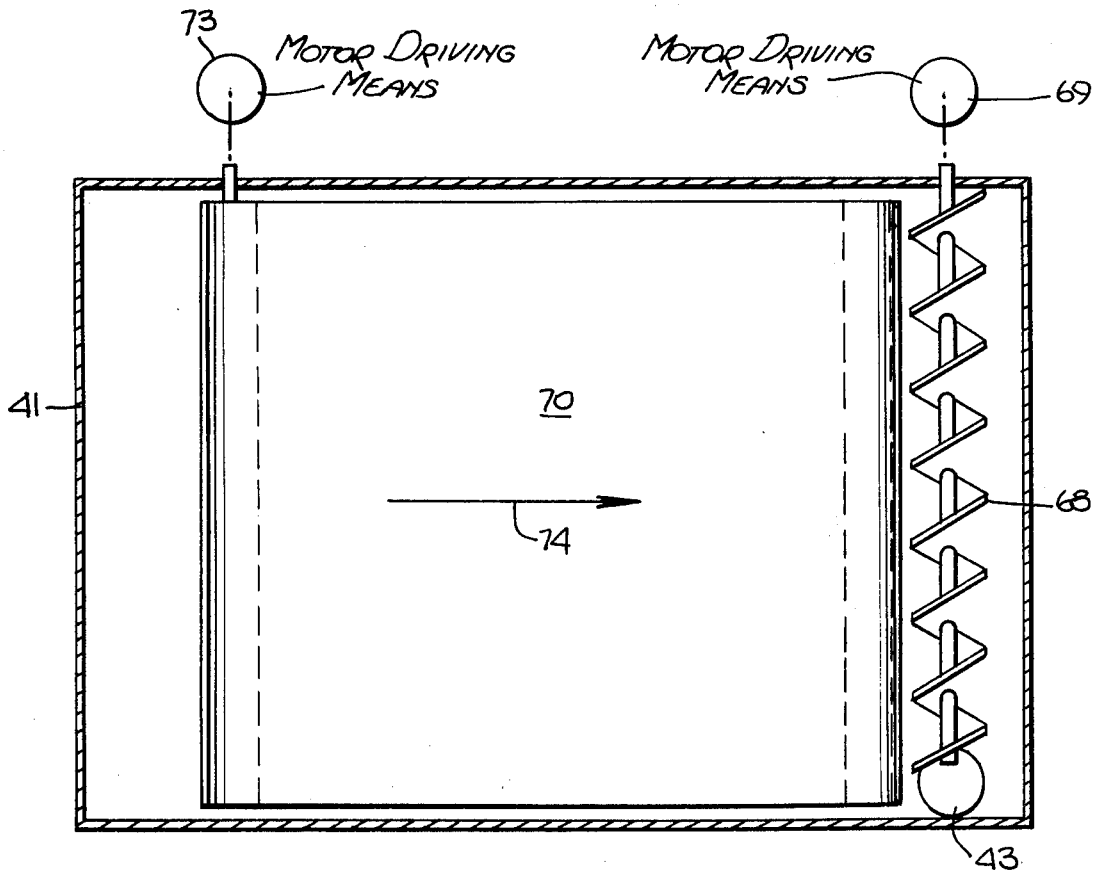
FIG. 7 is a plan view of a portion of the apparatus of the invention shown in FIG. 6 and is taken along the line 7—7 indicated in FIG. 6.

An alternative embodiment of the solids receiving means for receiving sticky solids is illustrated in FIGS. 6 and 7. In such embodiment, only a single moving belt 70 mounted on rollers 71 and 72, the roller 72 being driven by driving means 73, is mounted below the open end of the tube 10. The upper surface of the belt 70 moves in the direction of the arrow 74 and a knife or blade 75 is positioned adjacent the roller 72 and in contact with the surface of the belt 70 so as to scrape solids from the surface thereof. The solids fall into the sump 76 and are conveyed by the screw conveyor 68 to the removal valve 43.

Figure 8:
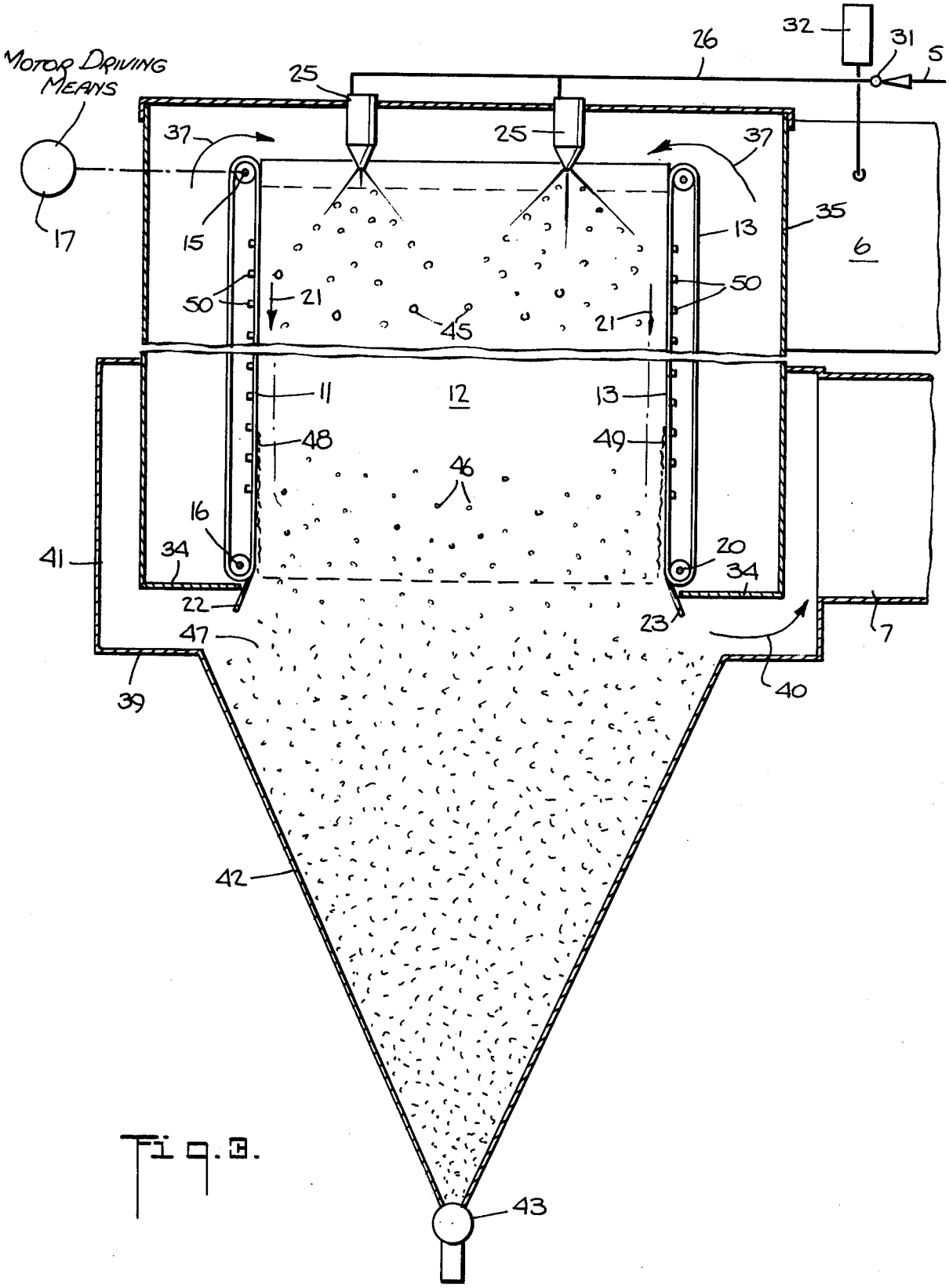
FIG. 8 is a diagrammatic side elevation view, partly in cross-section, of an alternative embodiment of the apparatus of the invention.

Although the preferred embodiment comprises a tube 10 formed by a plurality of moving belts 11–14, the tube into which the liquid-solid mixture is sprayed may be a tube of circular cross-section mounted for rotation about its axis. Such an alternative embodiment of the apparatus of the invention is illustrated in FIGS. 8 and 9, which show a tube 80 mounted for rotation around its axis 81, the axis 81 being vertical. The tube 80 may be supported from a surrounding tube 82 by means of heat resistant bearings 83 and may be rotated around its vertical axis 81 in any conventional manner, such as by the roller 84 in frictional engagement with the tube 80 and driven by a driving means 85.

The upper end of the tube 80 may be provided with a flange 86 overlapping a ring 87 on the wall of the tube 82 so as to restrict passage of the heated gases around the outside of the tube 80. The tube 80 may also be provided with a flange 88 adjacent the bearings 83 so as to protect the bearings 83.

The tube 80 may be made of the materials described hereinbefore for forming the belts 11–14, but, of course, in the embodiment of FIGS. 8 and 9, the wall of the tube 80 should be relatively rigid. The tube 80 may also be made of steel coated with an anti-adhesive material, such as the plastics sold under the trademarks TEFLON or KYNAR.

The liquid-solid mixture is sprayed into the interior of the tube 80 by the nozzles 25 as described hereinbefore, and any solids which may accumulate on the inner surface of the tube 80 are removed therefrom by one or more knives or blades, such as the knife or blade 89, mounted so as to engage the inner surface of the tube 80. In other respects the construction and operation of the apparatus shown in FIGS. 8 and 9 are the same as the construction and operation of the embodiment of the invention illustrated in FIGS. 2 and 3. Although not preferred because of the accumulation of solids on the blade 89 and its supporting parts, the tube 80 may be held stationary and the blade 89 may be mounted for rotation around the axis 81.

Although preferred embodiments of the invention have been described and illustrated, it will be understood by those skilled in the art that various modifications may be made without departing from the principles of the invention.

What is claimed is:

1. Apparatus for separating liquid from a liquid-solid mixture which comprises a liquid having a solid therein, said apparatus comprising a first tube with a substantially peripherally continuous wall, solids scraping means engaging said wall for removing solids deposited on said wall, mounting means movably mounting one of said wall and said scraping means, driving means connected to said one of said wall and said scraping means for moving said one thereof, said tube having a first end and a second end spaced from said first end, spraying means at said first end of said tube for spraying said mixture in finely divided form into said tube and toward said second end, heated gas supplying means at one end of said first tube for supplying a flow of heated gas to the interior of said first tube at said one end and into contact with the sprayed mixture whereby said gas flows from said one end of said first tube to the other end thereof and mixes with said sprayed mixture, gas removal means at said other end of said first tube for removing said gas from said tube at said other end thereof as it reaches said other end, and solids receiving means at said second end of said first tube for receiving solids from within said first tube and solids removed from said wall by said scraping means.

2. Apparatus as set forth in claim 1 further comprising a second tube around and having its interior spaced from said first tube, and wherein said heated gas supplying means also supplies heated gas to the interior of said second tube.

3. Apparatus as set forth in claim 2, wherein said wall of said first tube comprises at least three belts extending vertically and each mounted on vertically spaced rollers with the edges of said belts adjacent each other to form said substantially peripherally continuous wall, wherein said driving means comprises motor means connected to at least one of said rollers for each belt, whereby each belt is moved along a vertical path, and wherein said scraping means is a plurality of stationary blades corresponding in number to the number of said belts.

4. Apparatus as set forth in claim 3, wherein said gas supplying means comprises means for supplying gas to the interior of said second tube at a pressure greater than the pressure of the gas supplied to the interior of said first tube.

5. Apparatus as set forth in claim 4, wherein each of said belts has a portion with a first face facing interiorly of said first tube and a second oppositely facing face, and further comprising support means extending transversely of each belt and in contact with said second face thereof for supporting said portion.

6. Apparatus as set forth in claim 3, wherein said solids receiving means comprises a hopper extending downwardly and below said second tube and further comprising means on said hopper for removing solids therefrom.

7. Apparatus as set forth in claim 3, wherein said solids receiving means comprises at least one further belt mounted for movement below said second end of said first tube and said end of said second tube, driving means connected to said further belt for moving said further belt, scraping means engaging said further belt for removing solids therefrom and means adjacent said further belt for receiving solids scraped from said further belt.

8. Apparatus as set forth in claim 7, wherein there are a plurality of said further belts having upper surfaces lying in planes extending at an angle to each other, and wherein said last-mentioned scraping means comprises a plurality of blades corresponding in number to the number of said further belts.

9. Apparatus as set forth in claim 7, further comprising screw conveyor means adjacent an end of at least one of said further belts for receiving and conveying solids scraped from said last-mentioned further belt.

10. Apparatus as set forth in claim 1, wherein said wall of said first tube comprises at least three belts extending vertically and each mounted on vertically spaced rollers with the edges of said belts adjacent each other to form said substantially peripherally continuous wall, wherein said driving means comprises motor means connected to at least one of said rollers for each belt, whereby each belt is moved along a vertical path, and wherein said scraping means is a plurality of stationary blades corresponding in number to the number of said belts.

11. Apparatus as set forth in claim 10, wherein each of said belts is substantially imperforate with respect to the passage of said gas therethrough.

12. Apparatus as set forth in claim 10, wherein said heated gas is a mixture of gases with solids suspended therein and wherein said liquid-solid mixture comprises a material which forms a solid with a gas in said mixture.

13. Apparatus as set forth in claim 12, wherein said gas comprises a material selected from the group consisting of sulfur and sulfur containing gases and wherein said liquid-solid mixture comprises water and calcium.

14. Apparatus as set forth in claim 1, wherein said tube comprises a hollow cylinder and said mounting means comprises means for mounting said tube for rotation about the axis of said cylinder.

15. Apparatus as set forth in claim 14, wherein said axis is substantially vertical and wherein said solids receiving means comprises a hopper below said cylinder and further comprising means on said hopper for removing solids therefrom.

* * * * *